US007878031B2

(12) United States Patent
Varga

(10) Patent No.: US 7,878,031 B2
(45) Date of Patent: Feb. 1, 2011

(54) HAND-HELD WRINGER

(76) Inventor: George Varga, P.O. Box 9271, Jupiter, FL (US) 33468

( * ) Notice: Subject to any disclaimer, the term of this patent is extended or adjusted under 35 U.S.C. 154(b) by 238 days.

(21) Appl. No.: 12/174,654

(22) Filed: Jul. 17, 2008

(65) Prior Publication Data

US 2009/0019897 A1 Jan. 22, 2009

Related U.S. Application Data

(60) Provisional application No. 60/950,248, filed on Jul. 17, 2007.

(51) Int. Cl.
*D06F 45/24* (2006.01)

(52) U.S. Cl. ..... 68/244; 68/250; 68/252

(58) Field of Classification Search ..... 68/241, 68/244, 247, 250, 251, 252
See application file for complete search history.

(56) References Cited

U.S. PATENT DOCUMENTS 1,839,748 A * 1/1932 Evans ..... 15/262
2,288,847 A * 7/1942 Schroeder ..... 68/253 R
2,352,845 A * 7/1944 McGowan, Jr ..... 68/248
2,655,681 A * 10/1953 Arthur ..... 15/262
2,811,847 A * 11/1957 Morgan ..... 68/213
2,852,925 A * 9/1958 Johnson ..... 68/244
3,010,305 A * 11/1961 Braun ..... 68/214
3,142,068 A * 7/1964 Leventhal ..... 4/666
3,377,827 A * 4/1968 Drury ..... 68/248
3,430,286 A * 3/1969 Bownes ..... 15/257.01
3,604,226 A * 9/1971 Racenis ..... 68/263 B
3,669,487 A * 6/1972 Roberts et al. ..... 294/104
3,859,670 A * 1/1975 Crump, Jr. ..... 68/235 D
4,920,877 A 5/1990 Foster et al.
5,193,364 A 3/1993 Leenders
6,571,586 B1 6/2003 Ritson et al.
2007/0084010 A1 4/2007 Evans et al.

* cited by examiner

*Primary Examiner*—Frankie L Stinson
(74) *Attorney, Agent, or Firm*—McHale & Slavin, P.A.

(57) ABSTRACT

The present invention provides a hand-held wringer for removing liquid from a wet or damp material. A wet or damp material is placed between two rollers and a trigger handle is engaged to reduce the space between one roller's axis relative to an opposite roller's axis so as to expel liquid from every fiber of the material as it is pulled therethrough.

13 Claims, 6 Drawing Sheets

HAND-HELD WRINGER

CROSS-REFERENCE TO RELATED APPLICATIONS

This non-provisional application claims priority under 35 U.S.C. 119 (a) on U.S. Patent Application No. 60/950,248, entitled Hand-Held Wringer, filed Jul. 17, 2007, the entirety of which is incorporated herein by reference.

FIELD OF THE INVENTION

This invention relates generally to material wringers, and more particularly, to a hand-held roller type wringer with a spring pressure applying and releasing mechanism for removing liquid from a chamois, cloth, clothing, diaper, hosiery, mop, fabric, towel, undergarments, or like materials.

BACKGROUND OF THE INVENTION

Removal of water from land vehicles and water vehicles helps to maintain that shiny new showroom look on a vehicle. Proper maintenance requires drying off the exterior surface of the vehicle to effectively remove water spots that otherwise will remain on the surface of the vehicle. One of the many techniques vehicle owners have employed to dry their vehicles is a reusable chamois. The use of a chamois is common because it is highly absorbent, soft, and scratchless. Typically, the chamois is passed over the exterior surface of the vehicle to collect water before the water can evaporate and leave water spots on the exterior surface of the vehicle. However, a chamois is not capable of drying an entire vehicle without having to be wrung because the chamois becomes saturated with water; thus the chamois is typically wrung out by hand multiple times and then used again to continue drying the remaining wet exterior surface of the vehicle. Hand wringing the chamois is an effective way to expel water from the chamios but only if the user has strong hands; otherwise water is not expelled out evenly from the chamois and small areas of water will continue to remain on the chamois, thus the chamois will not perform as well as it did when it was dry.

Clearly, it would be helpful to make use of a wringer for the purposes of drying a chamois. However, a fixed wringer would not be convenient since it would be located at distance from vehicle. The use of fixed wringers has long been contemplated for expelling liquid, dating back to the 1930's when washing machines were commonly equipped with a wringer to remove excess water from clothes to allow for faster drying time. Although fixed wringers on the washing machines were convenient for when washing clothes when washing a vehicle it is disadvantageous and inconvenient for the vehicle owner to have to go a remote location apart from the quarters of the user or vehicle to use the wringer. The prior art, overcame this disadvantage with wringers mounted onto remote surfaces. For instance, U.S. Pat. No. 4,920,877 to Foster et al., discloses a hand crank wringer system constructed to be mounted to a wall or a similar structure. However, because of the mobility that comes with the use of a chamois and drying a vehicle, similar mobility would be desired in the '877 wringer. Other disadvantages associated with the '877 device is the use of a hand crank typically becomes tiresome and the mutual contact between the rollers, which allows for maximum expelling of water from the material, is typically lost over time. In addition, if getting to the wringer or the actual wringing takes too long, the wet vehicle which remains in the sun will begin to form water spots on the surface of the vehicle.

It would then be advantageous for the wringer to be just as mobile as the user, thus the user need not come to the wringer it should be near the user at all times for fast, effective, and portable utilization. However, typical portable wringers have its associated disadvantages. For instance, U.S. Pat. No. 6,571,586 to Ritson et al., discloses a hand crank chamois wringer that attaches to any flat surface using suction comprising of a support structure, and a pair of rollers driven by a crank handle. The support structure carries a suction device that with the turn of a suction cam lever the suction device sticks into place until the lever is released. The drawback is the need for a flat surface for the device to adhere to. Furthermore, it is not rigidly attached to the window so the device wobbles as the chamois is passed through the rollers. Additionally, U.S. Patent No. 2007/008404 A1 to Evans et al., discloses a chamois wringer that is easily and quickly installed on a support structure (i.e. backrest, bucket, bench, workstation, etc.) comprising of a wringer body containing the rollers, a wringer handle for operation and turning of the rollers, and a means to mount the wringer body to an external support structure. However, because a chamois is most likely to be used outdoors to dry a boat or a motor vehicle the dependency on a support structure to mount the wringer body makes the invention unviable because a sufficient support structure may not be readily available. Additional drawbacks in these two portable wringer devices are that the use of hand cranks may be tiresome for some users; and overtime the mutual contact between the rollers is lost due to mechanical failure. Thus the force applied on the chamois as it passes through the rollers to expel liquid is lost and sufficient liquid is not expelled.

Other portable wringer devices that maintain mutual roller contact are found in the prior art; however, ease of use is not so apparent. For instance, U.S. Pat. No. 5,193,364 to Leenders, discloses a chamois wringer that includes a base plate with an arm, herein known as a foot plate, pivotally connected thereto. A first roller is mounted on the base plate and a second roller is mounted on the pivotable arm, such that the pivoting of the foot plate will bring the second roller into rolling contact with the first roller. A chamois interposed between the rollers will be placed under compression as it is pulled up between the rollers. The compressive force is applied between the rollers by stepping on the footplate and water is thereby removed from the chamois. The drawback is that the device must be either used on a flat surface or affixed to a surface to be used effectively. The user is also forced to bend over to pass the chamois through the device, for a user with back problems this device may aggravate their condition. A potentially dangerous injury to a user's back may occur because the chamois is jerked through the rollers while force is being applied all the while the user is bend over.

While these patents disclose devices that may be suitable for their particular purpose to which they address, these devices would not be suitable for the purposes of the present invention as heretofore described.

SUMMARY OF THE INVENTION

As a consequence of these aforementioned problems, it is an objective of the present invention to provide a hand-held wringer for removing liquid from a wet or damp, chamois, cloth, clothing, diaper, fabric, hosiery, mop, towel, undergarment, or the like material. The hand-held wringer includes a support structure with a handle on one end and frame on the opposite end. The frame has a back wall and two substantially parallel sidewalls. Attached to the support structure is a trigger that pivots about a first axis from an engagement position to a release position. A first roller is rotatably secured to the frame's sidewalls for rotation about a second axis. A second roller is rotatably secured to the frame's sidewall near the frame's back wall for rotation about a third axis and coupled to actuator arms. The second roller's axis is translatable from a release position, where the third and second axis' are furthest apart, to an engagement position, where the space between the third axis and second axis are reduced. The actuator arms are coupled to the top end of the trigger on one end and the second roller's third axis on the other. A biasing member, attached to the back end of frame on one end and the trigger on the other, provides the necessary biasing force to revert the trigger handle to the release position. The trigger manually drives the actuator arms forward and thrusts the second roller forward so as to reduce the space between the second roller and the first roller. The wet or damp material is taken and placed in between the two rollers when the trigger is in the release position. To expel the liquid, the trigger is engaged and the second roller is propelled forward towards the first roller until the chamois is pinned in between the first and second roller. The chamois is then pulled through the rollers in one direction. The rotation of the rollers allows the chamois to slide through the two rollers and as the chamois is pulled therethrough the rollers squeeze the chamois so tight that water is pushed out of every fiber of the chamois.

Accordingly, it is an objective of the present invention to provide a portable hand-held wringer that is readily available to a user to expel liquid from a chamois, cloth, clothing, diaper, fabric, hosiery, mop, towel, undergarment, or the like. The hand-held wringer combines mobility and handiness which is lacking in prior art.

It is an objective of the present invention to provide a hand-held wringer that extends the life of a chamois, cloth, clothing, diaper, fabric, hosiery, mop, towel, undergarment, or the like.

It is a further objective of the present invention to provide a hand-held wringer that is portable, convenient, versatile, handy, mobile, and easy to use.

It is another objective of the present invention to provide a hand-held wringer that requires minimal force to engage.

It is an additional objective of the present invention to provide a hand-held wringer that is an inexpensive and affordable device for both commercial and residential use.

It is yet another objective of the present invention to provide a hand-held wringer device which can be safely operated by relatively inexperienced users.

It is yet another objective of the present invention to provide a hand-held wringer device with a locking member to hold the trigger handle in place while in an engaged position. The locking member also provides a means to hang the present invention while not in use.

It is yet another objective of the present invention to provide a hand-held wringer device without a hand-crank to minimize force.

It is yet another objective of the present invention to provide a hand-held wringer device with rollers allowing for a selective amount of force exerted by the rollers on the material passing through the two rollers.

It is yet another objective of the present invention to provide selective distance between the rollers whereby thick and thin pieces of material may pass through the rollers.

It is yet another objective of the present invention to provide at least one roller connected motor. The motor being connected to a power source for rotation of the roller about its axis. The motorized roller will aid in passing delicate material through the rollers to prevent damage to the delicate material.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
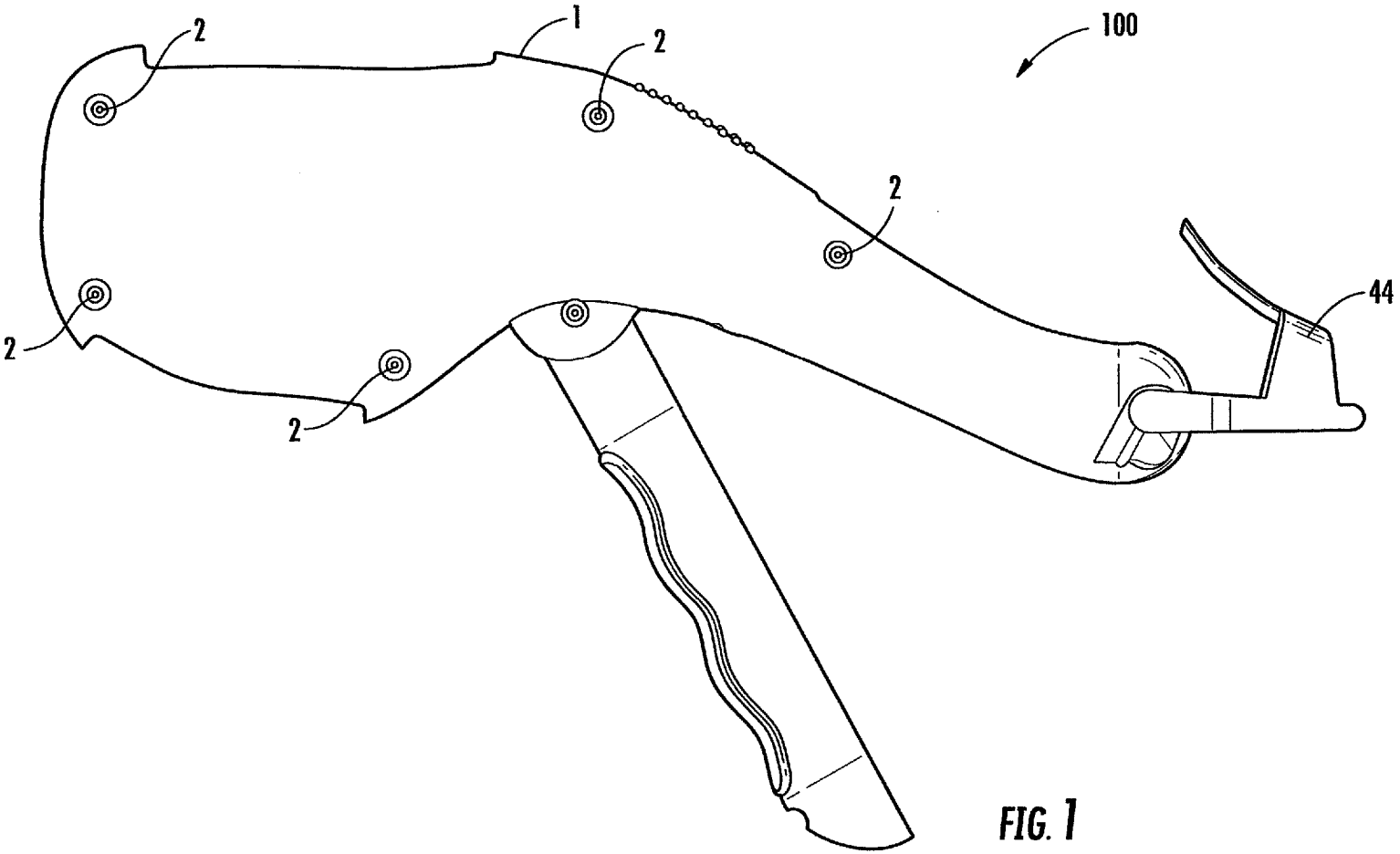
FIG. 1 is a side view of the present invention.
Figure 2:
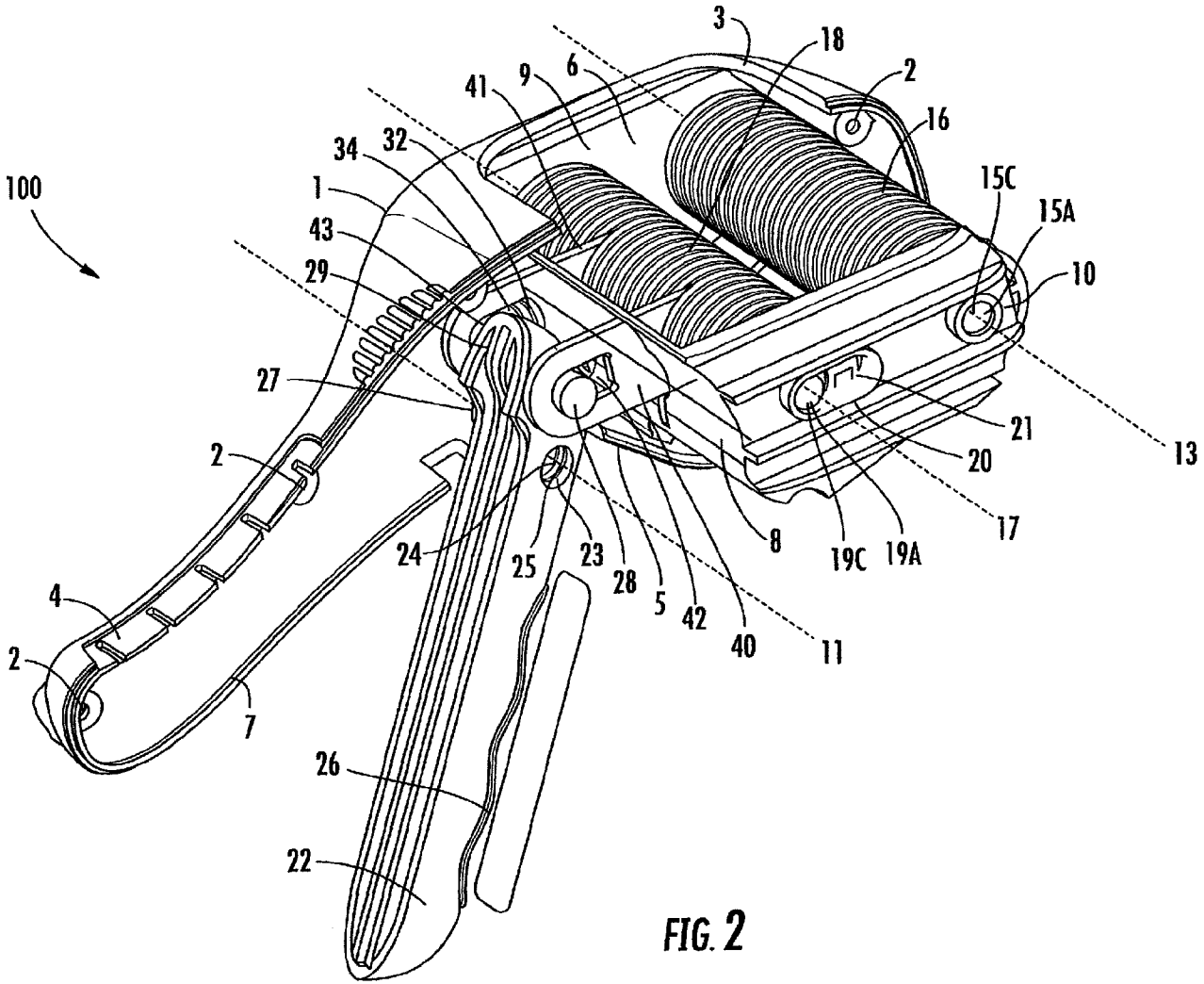
FIG. 2 is a cross-sectional perspective view of the present invention.
Figure 3:
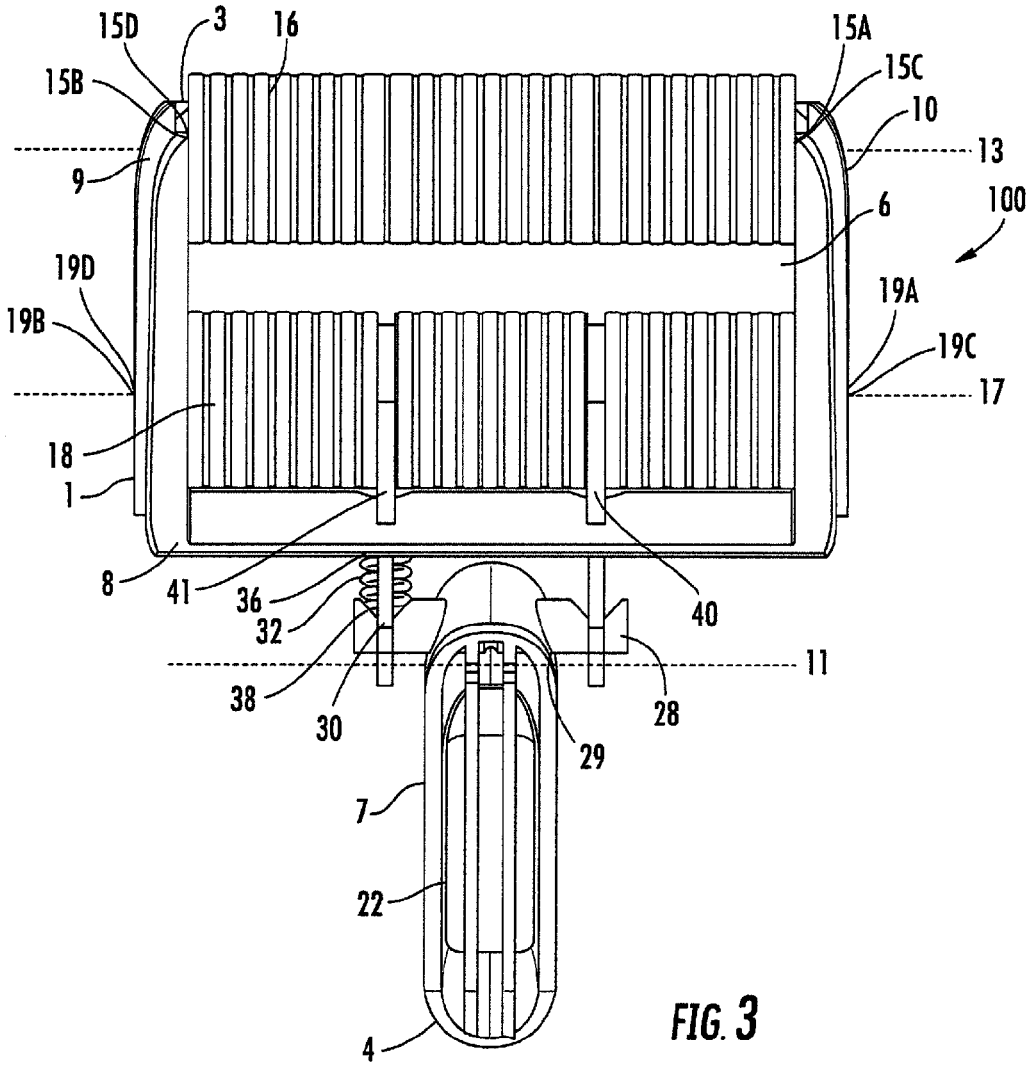
FIG. 3 is a cross-sectional top view of the present invention.

Referring now to FIGS. 1-6, wherein like elements are numbered consistently throughout, FIGS. 1-3 illustrate the preferred embodiment of the hand-held wringer, generally referenced herein as 100. The hand-held wringer 100 is comprised of a support structure 1. The support structure 1 is constructed of plastic molding, however, composite material, metal, Plexiglas® (acrylic glass or polymethyl methacrylate), or the like are suitable alternatives. The support structure 1 is made up of two mirrored halves that are reciprocated together at a plurality of corresponding mating points 2 on each halve to form an enclosed structure with all elements housed within or attached to the support structure 1, shown in FIG. 1; however, an alternative embodiment contemplates a support structure 1 made up of one integral piece. The corresponding mating points 2 can be any one of a number of different types of reciprocated means for attaching one structure to another such as but not limited to studs, rivets, or the like.

Referring to FIGS. 2 and 3, the support structure 1 has a front portion 3, rear portion 4, and intermediate portion 5 positioned between the front and rear portion. The rear portion 4 defines a handle 7. The front portion 3 constructed and arranged to hold a frame 6 whereby two rollers, 16 and 18, are housed within. The frame 6 and front portion 3 of the support structure 1 are hollow throughout to allow a chamois, cloth, clothing, diaper, fabric, hosiery, mop, towel, undergarment, or the like to pass therethrough. The frame 6 has a back wall 8, and two substantially parallel sidewalls, 9 and 10. However, it is contemplated that the frame may have a front wall.

A first roller 16 is rotationally secured in placed within the frame 6 on its endpoints 15A and 15B to the frame's sidewalls 9 and 10. The first roller 16 is furthest to the frame's back wall 8. The first roller 16 rotates about a second axis 13 on bearings 15C and 15D located on the first rollers' end points 15A and 15B. The second axis 13 is a horizontal axis extending from sidewall 9 to sidewall 10 whereby the first roller 16 is conceived to rotate about. The first roller 16 has a substantially cylindrical cross section.

A second roller 18 is rotationally secured in place within the frame 6 on its endpoints 19A and 19B to the frame's sidewalls 9 and 10. The second roller 18 is nearest to the frame's back wall 8. The second roller 18 rotates about a third axis 17 on bearings 19C and 19D located on the second roller's endpoints 19A and 19B. The third axis 17 is a horizontal axis extending from sidewall 9 to sidewall 10 whereby the second roller 18 is conceived to rotate about. The third axis 17 is parallel to the first roller's second axis 13. The third axis 17 is translatable along a horizontal plane along the frame's sidewalls 9 and 10, specifically along a slidable mounting system 20. The second roller 18 and its endpoints 19A and 19B are slidably mounted to sidewalls 9 and 10 of the frame 6. The slidable mounting system 20 comprises of a hollow aperture 21, shaped like an elongated oval, on the surface of the frame's sidewalls 9 and 10. The second roller's endpoints 19A and 19B and bearings 19C and 19D are housed within the aperture 21 to translate the third axis 17 along a horizontal plane within the aperture 21. The second roller 18 has a substantially cylindrical cross section. It is contemplated that both the rollers may be constructed of plastic, or non-marring rubber, or pressed fibers coated with water impervious material, or a rigid core coated with a layer of resilient material. It is also contemplated that the rollers may have a smooth, or rough, or corrugated exterior surface. Corrugated rollers have a hill surface on one roller that meshes with the valley surface on the adjacent roller to assist in feeding material through the rollers and to maximize efficiency by minimizing required crank force.

A trigger handle 22, having a top end and bottom end, is pivotally secured to the intermediate portion 5 of the support structure 1. The trigger handle 22 rotates about a first axis 11 on a pivot point 24 located between the top and bottom end of the trigger handle 22. The first axis 11 rotates from an engagement position to a release position. The pivot point 24 comprises of an opening 23 traversing the trigger 22, a corresponding opening 27 on the intermediate portion 5, and a pin 25. When the opening 23 on the trigger 22 and corresponding opening 27 on the intermediate portion 5 mate the pin 25 is inserted therethrough to provide a point about which the trigger 22 rotates, this axis of rotation of rotation is the first axis 11. Along the length of the trigger 22 are a plurality of grooves 26. The plurality of grooves 26 are contours to fit the shape of a user's fingers to allow for greater comfort and handgrip. Furthermore, the top end of the trigger 22 includes a hole 29 that transverses the trigger 22; the hole 29 allows for a peg 28 to pass therethrough. The peg 28 and hole 29 have a cylindrical cross section. The peg 28 extends outwardly on both ends beyond the thickness of the trigger 22, thereby leaving the ends of the peg 28 exposed and not flush with the hole 29. On one end of the peg 28 is an eye 30 (not shown in FIG. 2), the eye 30 is to be connected with one end of a biasing member, discussed further below. Additionally, an actuation member, 40 and 41, is coupled to the each end of the peg 28, discussed further below.

In an engaged position, the second roller 18 translates about its endpoints 19A and 19B within the slidable mounting system 20 so that third axis 17 moves closer to the second axis 13 and the exterior surface of second roller 18 attempts to come into mutual contact with the exterior surface of the first roller 16. In the engaged position, the third axis 17 and second axis 13 are at their nearest distance. In a release position, the two rollers 16 and 18 are not in mutual contact and the second axis 13 and third axis 17 are at their furthest distance apart.

FIGS. 2 and 3 illustrates the biasing member; however, FIG. 3 more aptly illustrates a biasing member such as a compression coil spring 32 having two opposite ends, each end containing an eye hook, 36 and 38. Positioned between the ends of the compression coil spring 32 is a plurality of conical coil springs 34. On one end of the compression coil spring 32 the eye hook 36 is fixed to the back wall 8 of the frame 6, and on the opposite end the eye hook 38 is coupled to the eye 30 on the peg 28 traversing the trigger handle 22. The compression coil spring 32 is compression resistant. The engagement of the trigger handle 22 about its first axis 11 on its pivot point 24 drives the peg 28 forward and causes the compression coil spring 32 to provide resistance against the peg 28; the trigger handle 22 will want to return to its release position due to the compression resistant force the compression coil spring 32 exerts on the peg 28. The metal coil springs are made by winding a wire around a shaped former; typically coil springs are wound in an annealed (soft) condition and then tempered to achieve their strength as a spring. In a preferred embodiment, the coil spring used is a compression coil spring, which is designed to resist compression and have a hook at each end for attachment, however, it is contemplated that other mechanical devices, that are typically used to store energy and subsequently release it to maintain a compression force between contacting surface such as bellows, foam, or the like may be used. Although only one compression coil spring is shown, it is contemplated that another compression coil spring may be positioned on the opposite end of the peg to provide greater compression resistance. Furthermore, a compression coil spring may also be positioned between the rollers.

Referring to FIGS. 2 and 3, actuation members 40 and 41 are shown, the actuation member 40 and 41 are constructed and arranged to extend between the top end of the trigger handle 22 and the third axis 17. Each actuation member 40 and 41 has a front and rear end. The rear end contains a gap 42 whereby the peg 28, which traverses the trigger handle 22, is inserted into the gap 42. The front end is attached to the second roller's third axis 17. As shown, actuation members 40 and 41 are incorporated to the body of the second roller 18. The incorporation of the actuation members 40 and 41 and the second roller 18 involves the actuation member's cylindrical front end being flushly integrated into the cylindrical body of the second roller 18. In the preferred embodiment the actuation members 40 and 41 are incorporated into the body of the second roller 18; however, it is contemplated that the actuating members may be coupled to the end points 19A and 19B of the second roller 18. As the trigger 22 is engaged the peg 28 is thrusted forward, because peg 28 is inserted in the gap 42 on the rear end of the actuation members 40 and 41 the actuation members 40 and 41 are subsequently driven forward. The driving forward of the actuation members 40 and 41 reduces the space between the second roller's third axis 17 and the first roller's second axis 13. Thus the second roller 18 is propelled forward as it slides along its endpoints 19A and 19B within the slidable mounting system attempting to make mutual contact with the first roller 16. In the preferred embodiment two actuation members 40 and 41 are used, however, in alternative embodiments one actuation member is contemplated.

FIGS. 1-3 show the hand-held wringer 100 in the release position. The release position is when the user does not manipulate the trigger 22 and the second roller's third axis 17 is furthest away from the first roller's second axis 13. The angle between the trigger 22 and the handle 7 is dependent on the length of the compression coil spring 32 when the compression coil spring 32 is not compressed. The engaged position is when the user's fingers bring the trigger 22 back towards the handle 7, moving the bottom end of the trigger handle 22 in close proximity to the handle 7, thereby thrusting the peg 28 forward and simultaneously driving the actuation members 40 and 41 forward; thereby reducing the space between second roller's third axis 17 and first roller's second axis 13. The trigger handle 22 is capable of returning and remaining from an engaged position due to the force the compression coil spring 32 exerts on the peg 28.

Figure 4:
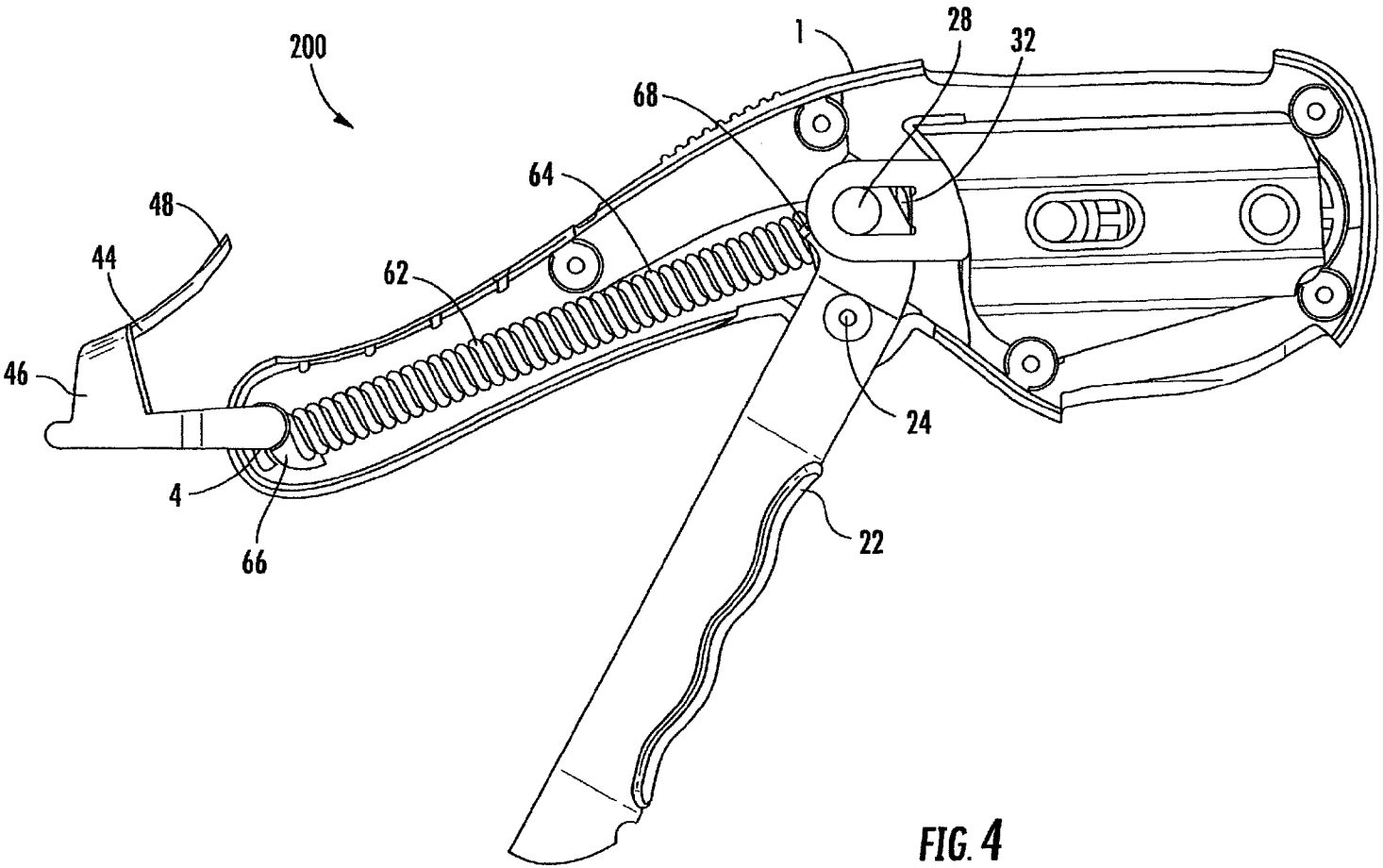
FIG. 4 is a cross sectional side view of an alternative embodiment of the present invention.
Figure 5:
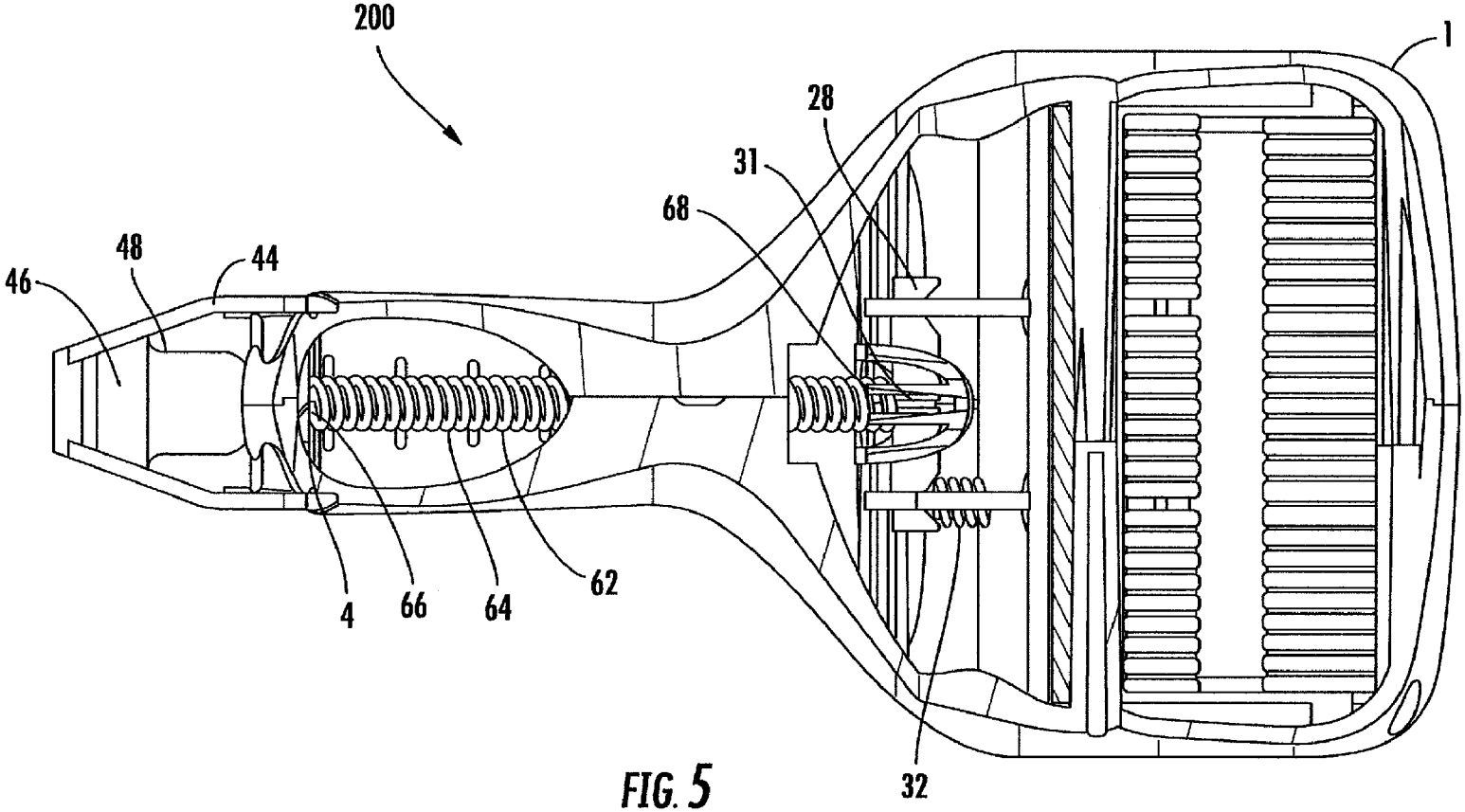
FIG. 5 is a cross sectional top view of an alternative embodiment of the present invention.
Figure 6:
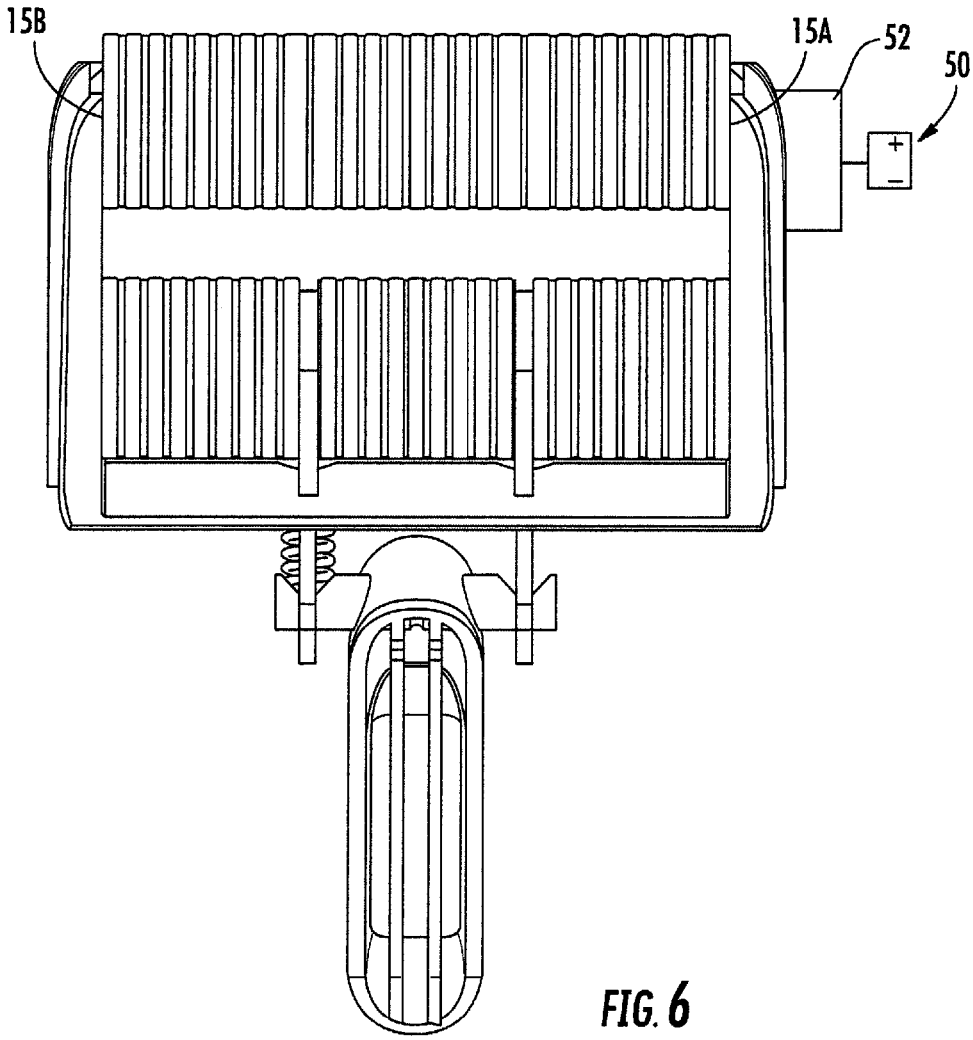
FIG. 6 is a cross-sectional top view of an alternative embodiment of the present invention.

FIGS. 4-6 illustrate an alternative embodiment of the hand-held wringer, generally referenced herein as 200. The hand-held wringer 200 contemplates the use of a tension coil spring 62 in addition to the elements described in hand-held wringer 100. The tension coil spring 62 has two opposite ends; each end contains an eye hook, 66 and 68, and positioned between the ends a plurality of conical coil springs 64. On one end of the tension coil spring 62 the eye hook 66 is fixed within the rear portion 4 of the support structure 1, and on the opposite end the eye hook 68 is coupled to an eye 31 on the midpoint of the peg 28 as shown in FIG. 5. The tension coil spring 62 is stretch resistant. The engagement of the trigger 22 about its pivot point 24 thrusts the peg 28 forward and causes the tension coil spring 62 to provide resistance against the peg 28. It is contemplated that the hand-held wringer may also be used without the use of the compression coil spring and employs only the use of tension coil spring. It is also contemplated that other biasing members, that are typically used to store energy and subsequently release it, to maintain a force between contacting surface such as rubber bands, resistance bands, or the like may be used in place of the tension coil spring.

An optional locking member 44 feature may be added to hand-held wringer 100 and 200, as shown in FIGS. 1, 4 and 5. A locking member 44 is contemplated for locking the trigger 22 in an engaged position so that the user does not have to keep his/her fingers on the trigger 22 to keep the trigger 22 engaged. The locking member 44 provides a user greater ease in handling the hand-held wringer. The locking member 44 is hinged at the rear portion 4 of the support structure 1. The locking member 44 rotates about the rear portion 4 of the support structure 1 and may attach to the bottom end of the trigger 22 when the trigger 22 is engaged. The locking member 44 has a cradle 46 adapted to hold the bottom end of the trigger 22 when the trigger 22 is in the engaged position. Additionally, the locking member 44 includes a loop 48 whereby the hand-held wringer may be fastened or hung.

Additionally, an optional motorized roller assembly 50 may be added to hand-held wringer 100 and 200, as shown in FIG. 6. The motorized roller assembly 50 includes a motor 52 being connected to an outside power source. The motorized roller assembly being connected to at least one roller about at least one endpoint. The motorized roller assembly 50 allows for rotation of the roller about its axis. The motorized roller assembly 50 may be located on the sidewalls of the support structure, as shown, or within the roller body. The motorized roller assembly 50 will aid in passing delicate material through the rollers to prevent damage or stretching to the delicate material.

Furthermore, an alternative embodiment, not shown, describes a hand-held wringer with a cam assembly that replaces the peg on hand-held wringer 100 and 200. The cam assembly comprises of a drive shaft and driven actuation member. The drive shaft is with the top end of the trigger handle. The drive shaft contains a notch and inserted within the notch is an actuation member. The driven actuation member is a U-shaped bar, in which the open ends attach to the endpoints of the second roller as discussed above in an alternative embodiment, and at the closed end the apex is inserted within the notch of the drive shaft. The drive shaft is driven by any number of devices that are typically used to store energy and subsequently release it; herein a tension coil spring and/or compression coil spring is contemplated. When the trigger handle is engaged a biasing force is provided by the tension and/or compression coil spring, the drive shaft then advances the driven actuation member forward so that the space between the second roller's third axis and first roller's second axis is reduced; and the coil spring acts to force the drive shaft back to the release position. The tension coil spring is fixed on one end at the rear portion of the support structure and connected to the top end of the trigger handle on the other end. The compression coil spring is fixed on one end at the back end of the frame and coupled to the top end of the trigger handle on the other end.

The hand-held wringer 100 and 200 is to be used to expel liquid from a chamois, cloth, clothing, diaper, fabric, hosiery, mop, towel, undergarment, or the like. The wet or damp chamois is taken and placed in between the two rollers when the trigger handle 22 is in the release position. To expel the liquid, the trigger handle 22 is engaged and the second roller 18 is propelled forward towards the first roller 16 until the chamois is pinned in between the first and second roller, 16 and 18, respectively, or until second roller 18 is in mutual contact with the first roller 16. The chamois is then pulled through the rollers 16 and 18 in one direction. The rotation of the rollers 16 and 18 allows the chamois to slide through the two rollers 16 and 18 and as the chamois is pulled therethrough the rollers 16 and 18 squeeze the chamois so tight that water is pushed out of every fiber of the chamois.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A hand-held portable wringer for removing liquid from a damp material comprising:

a frame formed from a two piece support structure having a first halve defined by a front portion, a sidewall, a rear portion, and an intermediate portion positioned between said front and rear portion, and a second halve forming a substantially mirror image of said first halve and defined by a front portion, a sidewall, a rear portion, and an intermediate portion positioned between said front and rear portion, means for securing said first halve to said second halve;

a trigger handle, having a top end and a bottom end, said top end pivotally connected to said intermediate area for rotation about a first axis wherein said trigger handle rotates between an engagement position and a release position;

a first roller rotationally secured to said first and second halve sidewalls for rotation about a second axis;

a second roller rotationally secured to said first and second halve sidewalls for rotation about a third axis; said third axis is translatable along a portion of said sidewalls allowing for the adjustment of spacing between said rollers; and at least one actuating member constructed and arranged to extend between said top end of said trigger handle and said second roller, wherein engagement of said trigger causes the top end of said trigger handle to rotate about said first axis and drive said actuating member to move said second roller towards said first by reducing the space between said third axis and said second axis.

2. The hand-held portable wringer of claim 1, including at least one biasing member to separate said third axis from said second axis when said trigger handle is in a release position.

3. The hand-held portable wringer of claim 2, wherein said at least one biasing member is defined as a coil spring.

4. The hand-held portable wringer of claim 2, wherein said at least one biasing member has a first end and second end, said first end fixed at said rear portion of said support structure, and said second end coupled to said top end of said trigger handle.

5. The hand-held portable wringer of claim 1, wherein said second axis is movable in a substantially parallel plane to said third axis.

6. The hand-held portable wringer of claim 1, including a locking member adapted to hold said bottom end of said trigger handle when said trigger handle is in said engagement position.

7. The hand-held portable wringer of claim 1, wherein a plurality of grooves on the outer surface of said bottom end of said trigger handle are finger contours for ease in handgrip.

8. The hand-held portable wringer of claim 1, wherein at least one said roller is connected to a motor connected to a power source for rotation of said roller about said roller's axis.

9. A hand-held portable wringer for removing liquid from a damp material comprising:

a frame formed from a two piece support structure having a first halve defined by a front portion, a rear portion, and an intermediate portion positioned between said front and rear portion, and a second halve forming a substantially mirror image of said first halve defined by a front portion, a rear portion, and an intermediate portion positioned between said front and rear portion, means for securing said first halve to said second halve;

a trigger handle, having a top end and a bottom end, said top end pivotally connected to said intermediate area for rotation about a first axis wherein said trigger handle rotates between an engagement position and a release position;

a first roller rotationally secured to said first and second halve sidewalls for rotation about a second axis;

a second roller rotationally secured to said first and second halve sidewalls for rotation about a third axis; said third axis is translatable along a portion of said sidewalls allowing for the adjustment of spacing between said rollers;

a biasing member to separate said third axis from said second axis when said trigger handle is in a release position; and at least one actuating member constructed and arranged to extend between said top end of said trigger handle and said second roller, wherein engagement of said trigger causes the top end of said trigger handle to rotate about said first axis and drive said actuating member to move said second roller towards said first roller by reducing the space between said third axis and said second axis.

10. The hand-held portable wringer of claim 9, wherein said at least one biasing member is defined as a coil spring.

11. The hand-held portable wringer of claim 9, wherein said biasing member has a first end and second end, said first end fixed at said back wall of said frame, and said second end coupled to said top end of said trigger handle.

12. The hand-held portable wringer of claim 9, wherein said second axis is movable in a substantially parallel plane to said third axis.

13. The hand-held portable wringer of claim 9, including a locking member adapted to hold said bottom end of said trigger handle when said trigger handle is in said engagement position.

* * * * *